United States Patent [19]

Georget

[11] 4,310,361

[45] Jan. 12, 1982

[54] SUGAR CANE MILL FACILITIES FOR THE EXTRACTION OF SUGAR FROM SUGAR CANE

[75] Inventor: Jean-Pierre Georget, Denain, France

[73] Assignee: Fives-Cail Babcock, Paris, France

[21] Appl. No.: 215,394

[22] Filed: Dec. 11, 1980

Related U.S. Application Data

[63] Continuation of Ser. No. 58,185, Jul. 17, 1979, abandoned.

[30] Foreign Application Priority Data

Mar. 8, 1978 [FR] France ..... 78 22927

[51] Int. Cl.[3] ..... C13D 1/04; B30B 3/04

[52] U.S. Cl. ..... 127/5; 127/42; 127/43; 127/6; 100/160; 100/163 A; 100/168; 100/171; 100/193

[58] Field of Search ..... 100/160, 161, 162, 168, 100/163 A, 169, 171, 173, 193; 127/2, 5, 6

[56] References Cited

U.S. PATENT DOCUMENTS

| | | | |
|---|---|---|---|
| 1,124,643 | 1/1915 | Ogg | 127/2 X |
| 2,406,541 | 8/1946 | Hewlett | 100/173 X |
| 4,077,316 | 3/1978 | Georget | 100/163 R |
| 4,168,660 | 9/1979 | Zelle | 100/162 R |

FOREIGN PATENT DOCUMENTS

| | | | |
|---|---|---|---|
| 2050660 | 3/1971 | France . | |
| 2153574 | 9/1973 | France | 127/5 |
| 2310409 | 11/1974 | France | 127/6 |
| 2350400 | 5/1976 | France . | |

*Primary Examiner*—Michael S. Marcus
*Attorney, Agent, or Firm*—Kurt Kelman

[57] ABSTRACT

A sugar cane mill facility for the extraction with imbibition of sugar from sugar cane.

This mill is characterized by the fact that it includes a fourth roller placed in front of the upper roller, against which it presses and, above the inlet roller and mounted on a mobile support, means acting upon the said support in order to flexibly push the fourth roller towards the upper roller, adjustable stops hindering these two rollers from coming together, and a trash plate placed between the fourth roller and the inlet roller integral with the said mobile support. The juices extracted by pressure between the upper roller and the fourth roller can be recycled to the bagasse layer feeding the mill, either with the juices which have passed through this layer, or with the juices extracted by pressure between the upper roller and the inlet and outlet rollers.

10 Claims, 6 Drawing Figures

SUGAR CANE MILL FACILITIES FOR THE EXTRACTION OF SUGAR FROM SUGAR CANE

This application is a continuation of application Ser. No. 058,185, filed July 17, 1979, now abandoned.

The present invention concerns the extraction by pressure of sugar from sugar cane, by means of a battery of mills, with imbibition of the bagasse between the mills.

It is known that imbibition improves extraction and the longer the imbibition, the greater is the gain, at least within certain limits. However, if the installed devices cause the bagasse to retain too much liquid, the bagasse cannot be caught by the mill rollers and it is necessary to provide feeding systems for the mills.

Such a feeding system is, for example, constituted by two rollers which exert pressure on the bagasse layer in order to extract from it part of the liquid with which it is imbibed, and by a closed channel which connects the outlet of these two rollers to the inlet of a conventional three roller mill. This solution is costly and necessitates a considerable amount of extra power. Furthermore, the clearance of the rollers is set according to an average cane flow rate and the best results are only obtained at this flow rate. If the cane flow rate varies and particularly if it increases appreciably, there is a risk of clogging at the feed-end of the two rollers and in the channel.

Another system is constituted by a feed roller which presses against the upper roller of a conventional three roller mill, and a trash-plate placed between the feed roller and the inlet roller of the mill. Normally, this feed roller has a small diameter and its effectiveness is limited. It has been suggested that this feed roller be given a diameter nearly equal to that of mill rollers but, bearing in mind the arrangement of the rollers in conventional mills, this cylinder is thus at a higher level than that of the upper roller of the mill and an extra roller, called a "pushing roller", is placed above the upper roller. In this system also, the position of the feed roller is set for a given bagasse flow rate, and when the flow rate varies the effectiveness of the system is reduced.

The object of the present invention is to construct a cane mill fitted with a feeding system which is less costly and more effective than known devices and which allows a high rate of imbibition for the bagasse.

The cane mill of this invention includes, in addition to the three conventional rollers, a fourth roller placed in front of the upper roller, against which it presses, and above the inlet roller. The fourth roller is mounted on a mobile support which is resiliently biased towards the upper roller. Adjustable stops prevent these two rollers from contacting each other and a trash plate is placed between the fourth roller and the inlet roller, the trash plate being mounted on the mobile support.

It is advantageous for this fourth roller to be situated on the same level as the upper roller and to have nearly the same diameter. This arrangement is particularly favourable for the feeding of the mill by means of a vertical chute known as a "Donnely chute", and makes it possible to dispense with a pushing roller.

The biasing means are preferably constituted by hydraulic jacks connected to a hydro-pneumatic accumulator, so as to exert an almost constant pressure despite the variations in thickness of the bagasse layer which causes the fourth roller to move.

The opening between the upper roller and the fourth roller is between 1.8 and 2.5 times as great as the opening between the upper roller and the inlet roller.

The fourth roller support can be mounted on sliders provided on the mill frame and, in this case, the roller moves in a straight line. It can also be articulated on the mill frame, about a shaft parallel to the axes of the rollers. It is advantageous for the articulation shaft to be placed at the lower part of the frame.

This fourth roller is driven in rotation, either by the upper roller of the mill by means of pinions, or by an independent motor, for example a hydraulic motor, the speed of which is controlled by the speed at which the other rollers rotate.

The position of the trash plate on the roller support is preferably adjustable. A screen integral with the trash plate guide to the feed-end of the mill the juices extracted by pressure between the fourth roller and the upper roller and prevents them from falling onto the inlet roller. A gate is pivotally mounted on the mobile support and makes it possible to guide these juices either to the mill collector to a separate collector. Thanks to this possibility, various imbibition schemes can be adopted.

According to a preferred embodiment of the invention, the upper roller is carried by two levers pivoted on the frames supporting the inlet and outlet rollers and the fourth roller is mounted on bearings carried on a chassis pivoted on the frames about a shaft which is parallel to the axes of the rollers, said bearings being located between the said levers and respective frames.

In a factory for the extraction of sugar from sugar cane, constituted by a battery of mills at least one of which is a four roller mill of the type described above, the juices extracted by pressure between the upper roller and the inlet and outlet rollers of the, or of each four roller mill are used, in the conventional manner, for the imbibition of the bagasse feeding the previous mill, considering the direction in which the bagasse is moving forward, while the juices extracted by pressure between the upper roller and the fourth roller are collected separately and used for the imbibition of the bagasse feeding the said four roller mill with the juices which have passed through the bagasse layer and which are recycled.

The juices extracted by pressure between the upper roller and the fourth roller are preferably poured onto the layer of cane feeding the four roller mill further upstream than the juices coming from the next mill.

Alternatively, the juices extracted by pressure between the upper roller and the inlet and outlet rollers of the or of each four roller mill are also used for the imbibition of the bagasse feeding the said mill and are poured onto the bagasse layer further downstream than the juices extracted by pressure between the upper roller and the fourth roller which are collected separately, the imbibition of the bagasse feeding the previous mill being carried out by the juices having filtered through the said bagasse layer.

Other characteristics of the invention will become evident while reading the following description which refers to the accompanying diagrams which show some of the many ways in which this invention can be constructed.

Figure 1:
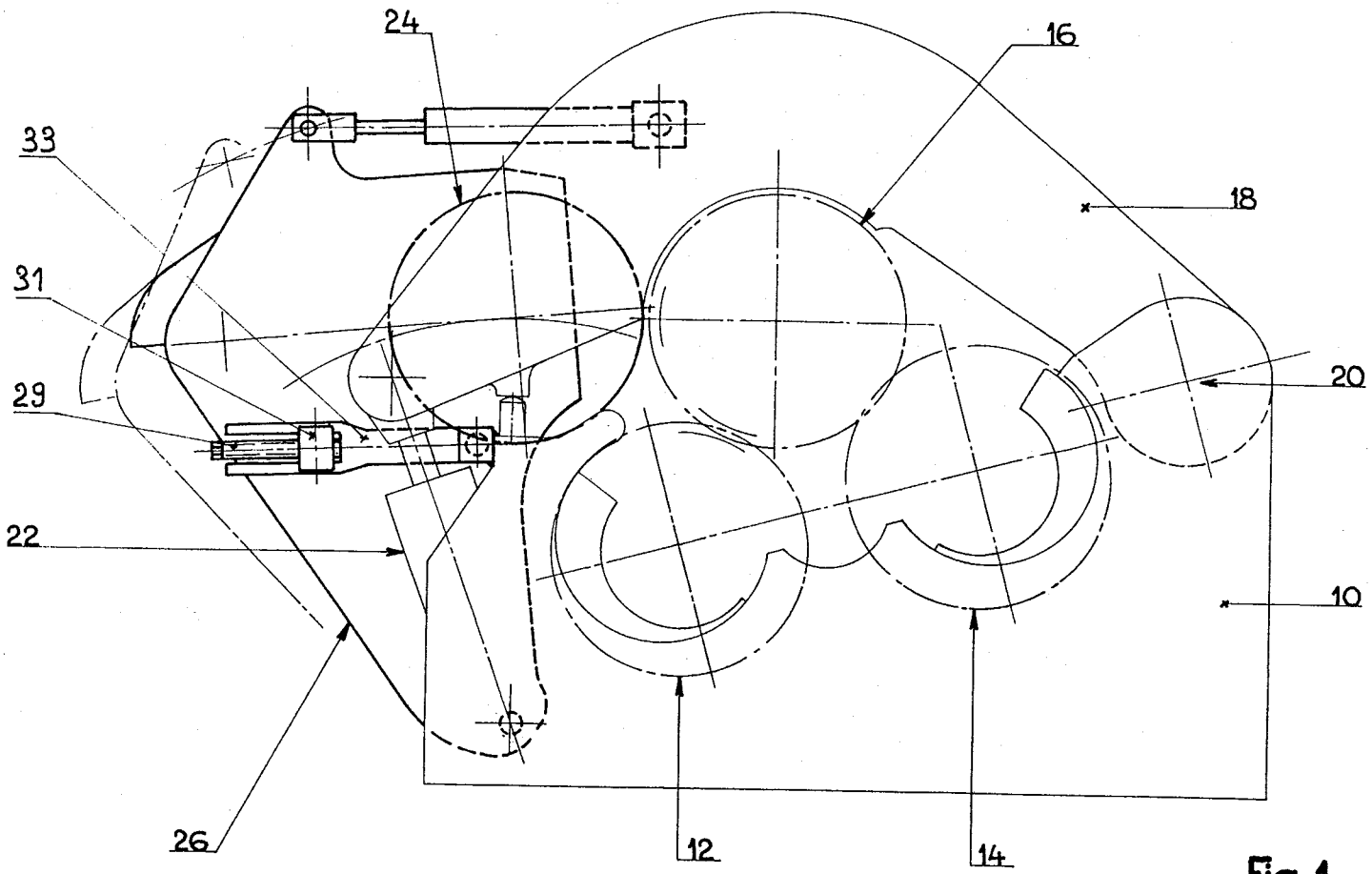
FIG. 1 is a side elevational view of a cane mill constructed in accordance with the invention.
Figure 2:
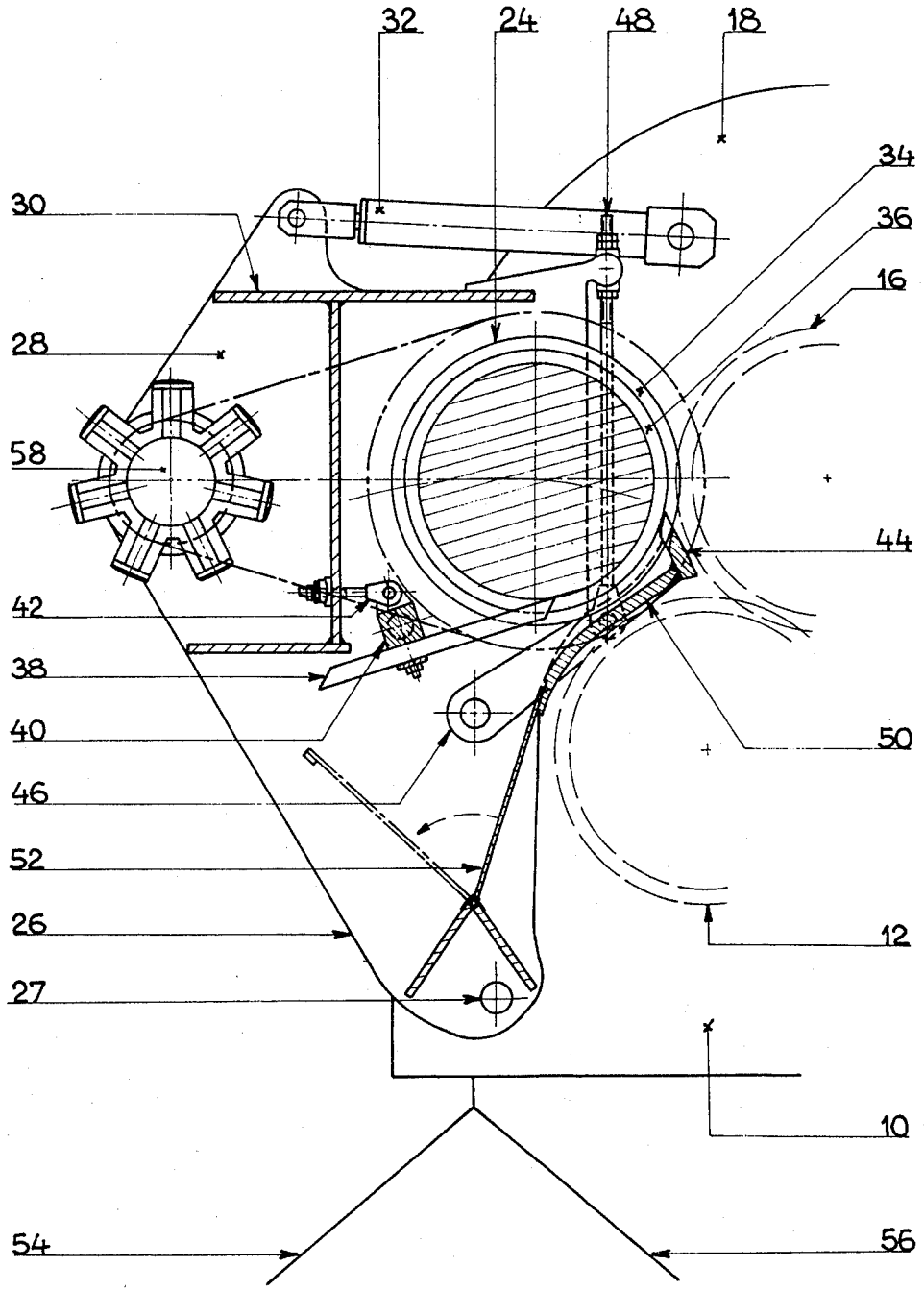
FIG. 2 is a larger scale sectional view showing the assembly of the fourth roller.

The cane mill shown in FIGS. 1 and 2 consists of two frames 10 fixed onto a base-plate or on foundations and each provided with two pillow blocks in which rest the end journals of the inlet roller 12 and outlet roller 14. The end journals of upper roller 16 are mounted in pillow blocks fixed to two caps 18 formed by bent levers articulated at point 20 on the frames 10. Roller 16 is resiliently biased towards rollers 12 and 14 by two hydraulic jacks 22 articulated on the frames 10 and the caps 18 and connected to a hydraulic power plant provided with a hydropneumatic accumulator which maintains the pressure in the jacks and, consequently, keeps the force exerted on the upper roller almost constant despite the movements of the latter. The minimal clearances between the upper roller and the inlet and outlet rollers are set by shims placed between the frames 10 and the free ends of the caps 18. The structure and arrangement of rollers 12, 14 and 16 are the same as those in conventional three roller mills of this type.

A fourth roller 24 is mounted on a chassis 26 articulated on the frames 10, about a shaft 27 parallel to the axes of the rollers. In the example, this shaft is aligned with the articulating shaft of the jacks 22 on the frames 10, but this arrangement is not imperative. The chassis 26 is located between the frames 10 and formed by two side plates 28 braced by a cross-piece 30. It is connected to the caps 18 by two jacks 32, each jack being articulated on a cap and on the chassis; the jacks 32 are connected to a hydropneumatic accumulator which keeps the hydraulic pressure practically constant when the chassis 26 pivots at a limited angle about the shaft 27.

The movement of the chassis 26 and, consequently, of the roller 24 towards the upper rolls 16 under the action of jacks 32 is limited by adjustable stops constituted, for example, by screws supported by the sides of the chassis and resting against the frames 10 or integral parts of these frames.

FIG. 1 shows a screw stop 29 which is screwed into a slide-block 31 pivotally mounted on the side of the chassis 26 and fitted between the prongs of a part in the form of a fork 33 articulated on the frame 10, the screw resting on the bottom of the fork; such a stop is provided on either side on the mill.

Roller 24 is situated at approximately the same level as roller 16 and its diameter is nearly equal to that of the other rollers. It is provided at both ends with journals mounted in pillow-blocks fixed onto the chassis 26 side-plates 38. Around the outside of the roller are formed circular grooves 34 with triangular cross-sections similar to the grooves formed on the rollers 12, 14 and 16; the angle at the top of the grooves 34 is however smaller than that of the grooves of rollers 12, 14 and 16. Ribs are formed between the grooves 34 and mesh with the upper roller grooves. Narrow and deep channels 36 with rectangular cross-sections are machined at the bottom of the grooves 34.

Knives 38 enter the channels 36 in order to ensure their cleaning. These knives are fixed adjustably onto a bar 40 provided at each end with journals mounted in the said plates of chassis 26. This bar can thus turn about its longitudinal axis, and its angular position and, therefore, that of the knives 38 is fixed adjustably by a rod, the threaded end of which carries a nut which rests on the web of cross-piece 30.

A trash plate 44 is fitted between the rollers 12 and 24; its upper edge is provided with teeth which enter the grooves 34. It is supported at each end by two arms 46 mounted pivotally about a shaft parallel to the axis of roller 24 on the chassis 26. The position of the trash plate is adjustable and fixed by two tie rods 48 hooked to arms 46. The threaded ends of these tie-rods are fitted with nuts tightened on a protuding section of chassis 26. The role of the trash plate 44 is to guide the bagasse coming from the gap between rollers 16 and 24 to the space between rollers 12 and 16, avoiding its expansion.

A screen 50 fixed onto the trash plate 44 is placed between rollers 12, 24 and over the whole of their length. The role of this screen is to keep the juices extracted by pressure between rollers 16 and 24 away from roller 12.

A gate 52 can pivot about its lower longitudinal edge, which is parallel to the axis of roller 24, between a first position in which it extends the length of the screen 50, as shown in continuous line in FIG. 2, and a second position shown in dotted lines in this figure. When the gate 52 is in its first position, the juices extracted by pressure between rollers 16 and 24 are separated from the juices extracted by pressure between rollers 12, 14 and 16 and gathered in a collector 54 separate from the main juice collector 56; when the gate is in its second position all the juices are gathered in collector 56.

In the example, roller 24 is driven by two hydraulic motors 58, one at each end, by means of chains and sprockets; it could be driven by sprockets from roller 16. Generally speaking, the rotation speed of roller 24 is slightly lower than that of roller 16. In the event that rollers 16 and 24 are driven separately, interlocking system is provided in order to maintain their speeds at a constant ratio.

Figure 3:
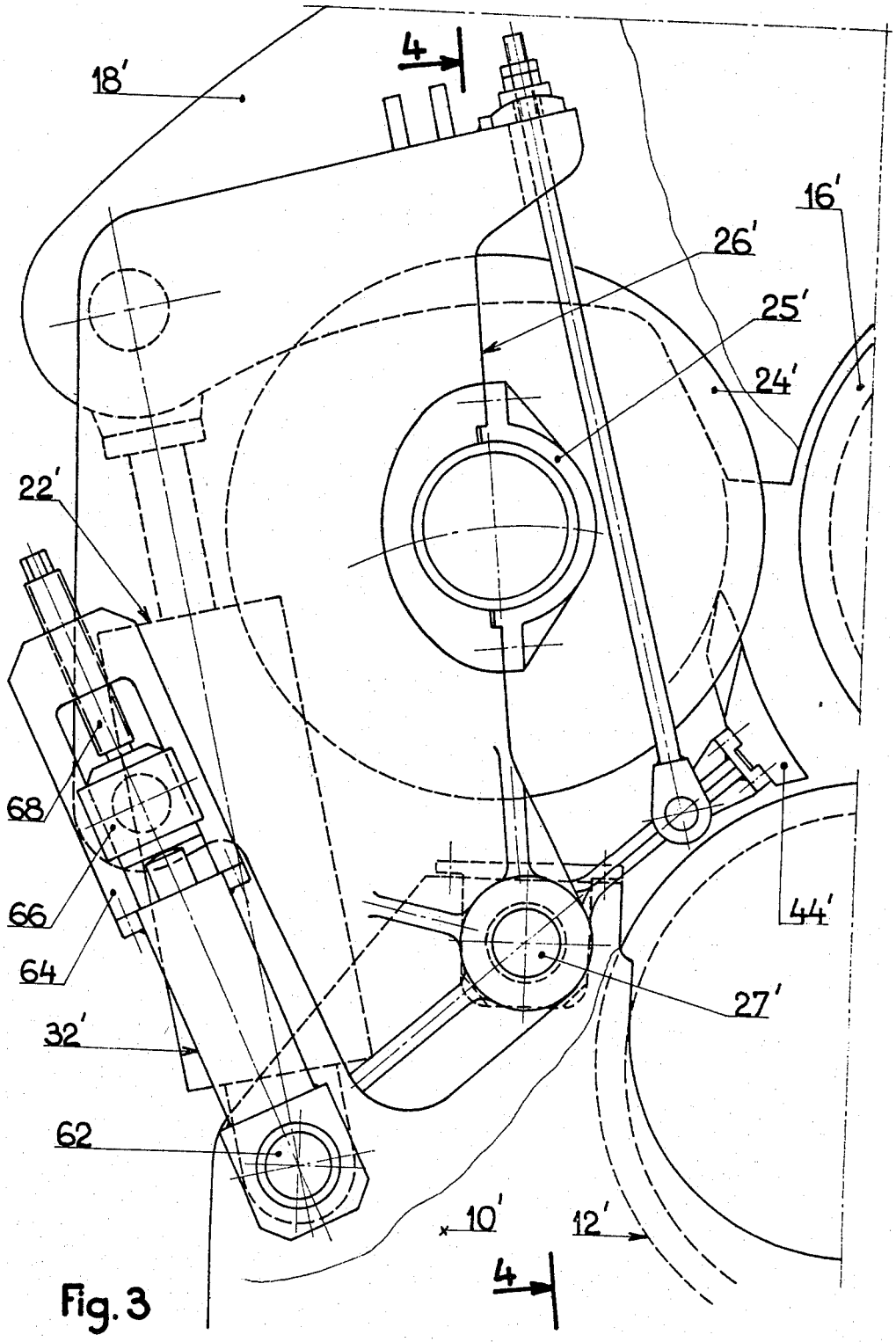
FIG. 3 is a side elevational view of another cane mill constructed in accordance with the invention, some elements being shown in cross-section.
Figure 4:
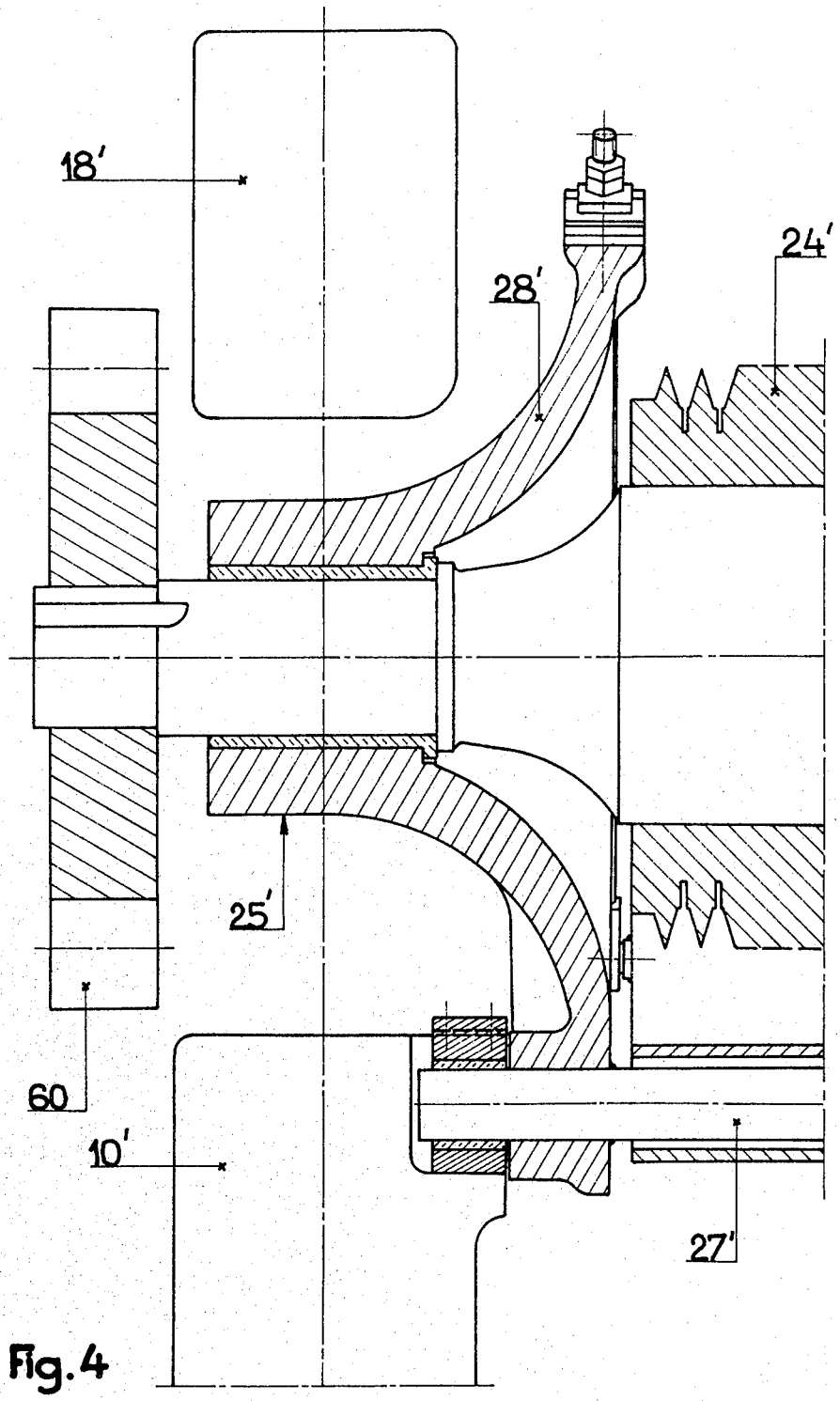
FIG. 4 is a cross-sectional view along line 4-4 of the mill of FIG. 3.

In the embodiment shown in FIGS. 3 and 4, the shaft 27′ which is supported on the frames 10′ and on which the cahssis 26′ is pivotally mounted is located at a slightly higher level than the axis of the inlet roller 12′; the shaft 27′ also supports the trash plate 44′.

The roller 24′ is supported at both ends by bearings 25′ fast with the side plates 28′ of the chassis 26′; the bearings are located above the frames 10′ and between the latter and the respective caps or levers 18′, as shown in figure 4. Roller 24′ is driven by means of a sprocket 60 fast with one end of the roller 24′ and meshing with a sprocket, not shown, fast with the upper cylinder 16′.

Roller 24′ is resiliently biased towards the upper roller 16′ by two hydraulic jacks 32′ connected to a hydropneumatic accumulator. These jacks are articulated on the frames 10′ by means of shafts 62 aligned with the articulating shafts of the jacks 22′ acting on the caps 18′. They are provided with a yoke 64 accomodating a slide-block 66 pivotally mounted on the sides of the chassis 26′. The slide-blocks 66 are pushed by the piston rods of the jacks 32′ against the ends of screws 68 carried by the yokes and constituting adjustable stops.

Figure 5:
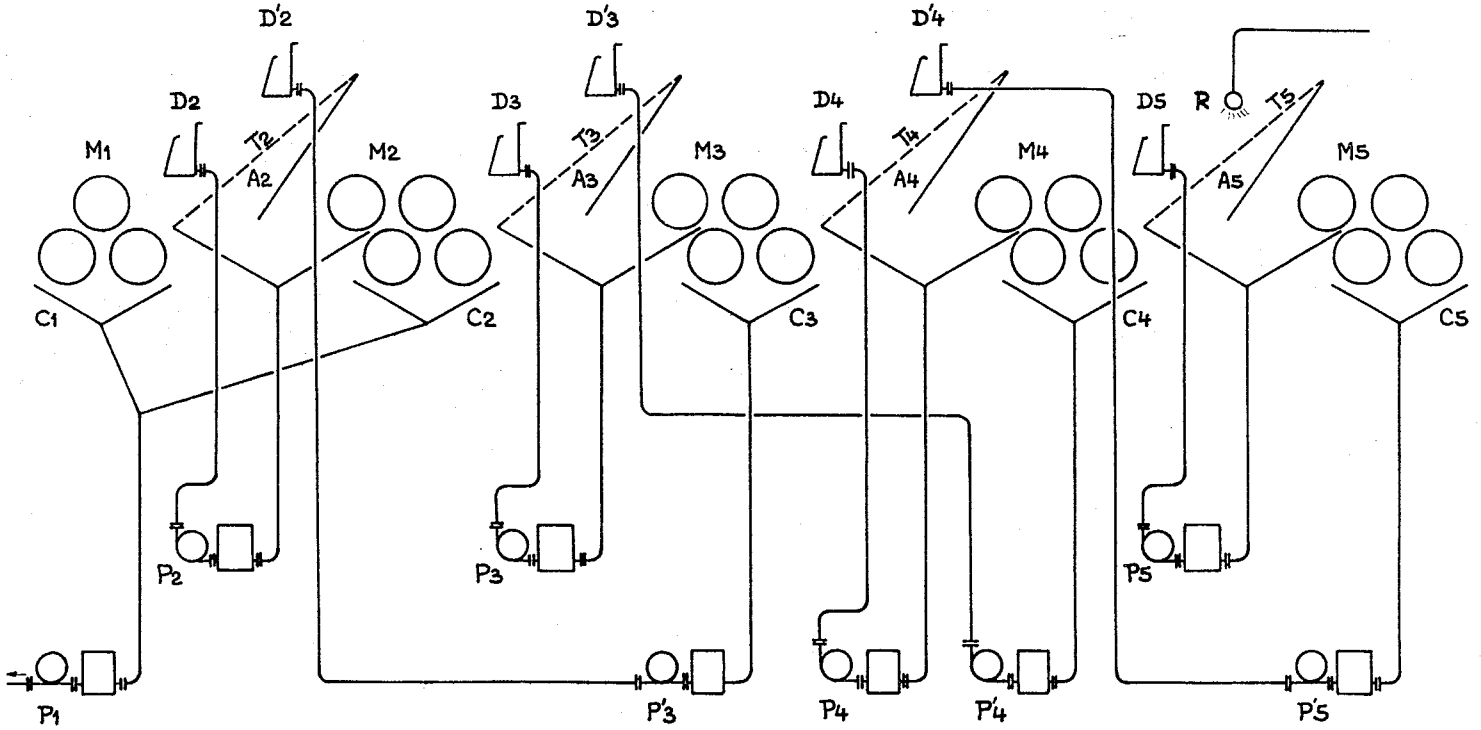
FIG. 5 is the diagram of a factory including several mills in accordance with the invention.

FIG. 5 is a diagram of a factory including five cane mills M1, M2, M3, M4 and M5. The first mill is a conventional three roller mill; the other mills are of the four roller type described above. The bagasse is conveyed from one mill to the following one by permeable conveyors T2, T3, T4 and T5. While being conveyed, the bagasse is imbibed with water or juices by means of weirs D2, D'2, D3, D'3, D4, D'4 and D5 located above the conveyors. The flows of water and juices poured down are such that part of them passes through the bagasse layer and is gathered beneath the conveyor in troughs A2, A3, A4 and A5. The juices extracted by pressure between the upper roller and the inlet and outlet rollers of mills M2, M3, M4 and M5 are gathered in collectors C2, C3, C4 and C5 and the juices extracted by pressure between the upper roller and the fourth roller of these mills are separated from the mills and gathered in troughs A2, A3, A4 and A5 respectively; The juices extracted by pressure in Mill M1 are gathered in a collector C1.

The juices gathered in troughs A2, A3, A4 and A5 beneath conveyors T2, T3, T4 and T5 respectively, are recycled to these conveyors by means of pumps P2, P3, P4 and P5 and weirs D2, D3, D4 and D5.

The juices gathered in collectors C3, C4 and C5 are poured onto conveyors T2, T3 and T4 respectively by means of weirs D'2, D'3 and D'4 placed downstream of weirs D2, D3 and D4. The bagasse on conveyor T5 is sprayed with water by means of a ramp R placed downstream of weir D5. The juices gathered in collectors C1 and C2 are sent to the production section.

Figure 6:
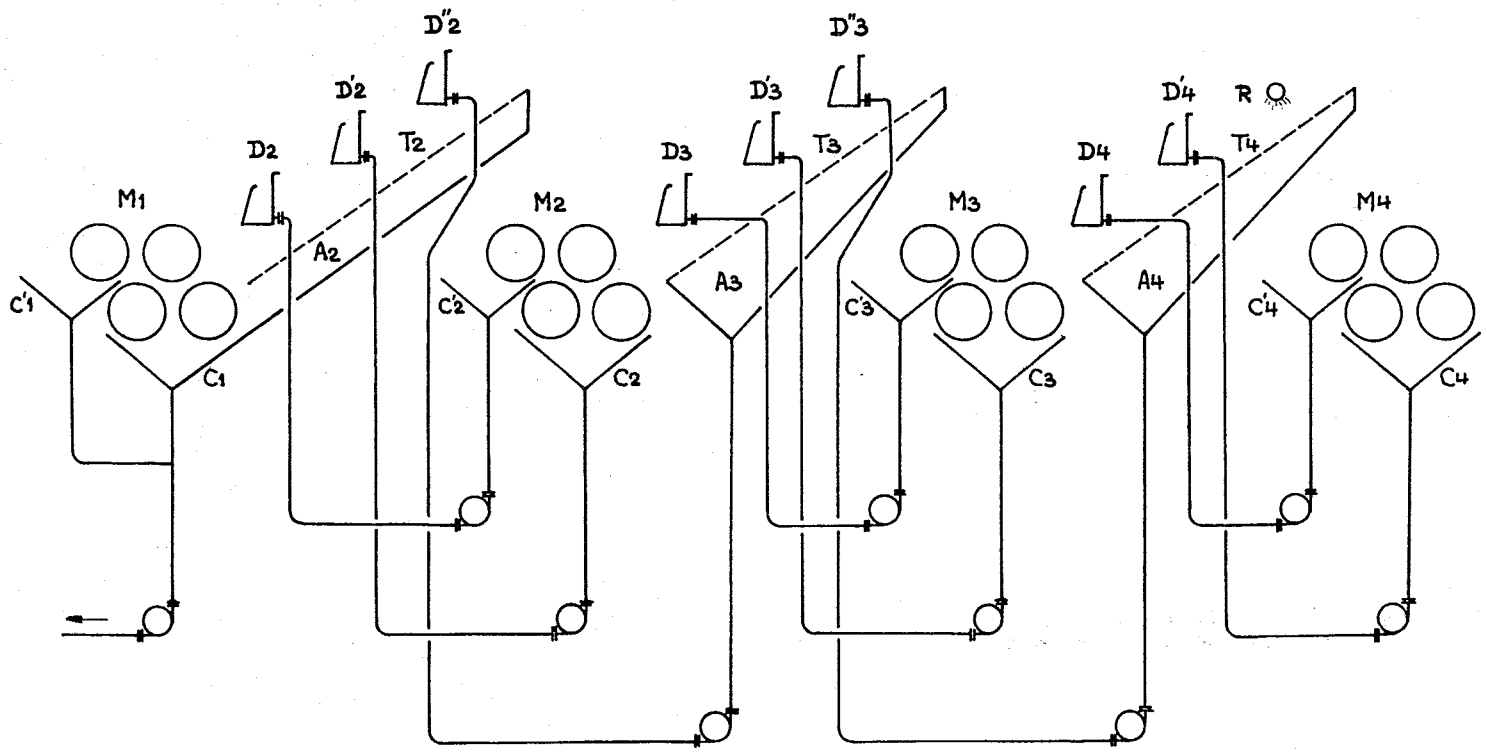
FIG. 6 is the diagram of another factory showing several mills in accordance with the invention.

The factory which is shown in FIG. 6 consists of four four-roller mills M1, M2, M3 and M4 of the type described with reference to FIGS. 1 and 2. Each mill has a main collector C1, C2, C3, and C4 for the juices extracted by pressure between the upper roller and the inlet and outlet rollers and an auxiliary collector C'1, C'2, C'3 and C'4 for the juices extracted by pressure between the upper roller and the fourth roller.

Permeable conveyors T2, T3 and T4 are placed between the mills and ensure that the bagasse is conveyed from one mill to the next. Troughs A2, A3 and A4 placed beneath the conveyors collect the juices which pass through the bagasse layer. Three weirs D2, D'2 and D''2 are placed above the conveyor T2 and are spaced out in this order from the upstream end to the downstream end. Similarly, three weirs D3, D'3 and D''3 are placed above conveyor T3. Two weirs D4 and D'4 are placed above conveyor T3 and a water ramp R is placed downstream of weir D'4.

The juices gathered in collectors C'2, C'3 and C'4 are sent by the pumps to weirs D2, D3 and D4 respectively and are thus recycled. The same applies to the juices gathered in collectors C2, C3 and C4 which are sent to weirs D'2, D'3 and D'4 respectively. The juices gathered in troughs A3 and A4 feed weirs D''2 and D''3 respectively and the juices gathered in trough A2 and collectors C1 and C'1 are sent to the production section.

In this factory, all the juices extracted by pressure in each mill could be gathered in a single collector and recycled by means of a single weir.

Numerous modifications can be applied to the mill and the factories described above by the use of equivalent technical methods. Concerning the mill, the known straight guiding system could be used for the upper roller instead of mounting it on pivoting caps. The fourth roller could also be mounted on sliders and move in a straight line. Of course, all these modifications are applicable to the invention.

I claim

1. A sugar cane mill comprising (a) a frame, (b) an inlet roller and an outlet roller mounted on the frame, (c) an upper roller resiliently biased towards the inlet and outlet rollers, the upper roller defining inlet and outlet nips with the inlet and outlet rollers, respectively, (d) a support and a pivot extending parallel to the inlet and outlet rollers and pivotally mounting the support on the frame, (e) a fourth roller mounted on the support forwardly of and at about the same level as the upper roller and above the inlet roller, the fourth roller having about the same diameter as and defining an opening with the upper roller, (f) means acting upon the support for resiliently biasing the fourth roller mounted thereon towards the upper roller, (g) adjustable stop means arranged to prevent the fourth roller resiliently biased towards the upper roller from contacting the upper roller, and (h) a trash plate placed between the fourth roller and the inlet roller, the trash plate being mounted on the support.

2. The sugar cane mill of claim 1, wherein the opening between the fourth roller and the upper roller is between 1.8 and 2.5 times the width of the opening between the upper roller and the inlet roller.

3. The sugar cane mill of claim 1, wherein the means acting upon the support comprises hydraulic jack means connected to the support and a hydro-pneumatic accumulator connected to, and controlling, the hydraulic jack means.

4. The sugar cane mill of claim 1, wherein the frame is comprised of two side plates supporting respective ends of the inlet and outlet rollers, and further comprising two levers pivotally mounted on the side plates and supporting respective ends of the upper roller, and bearings being arranged between the levers and the respective side plates.

5. The sugar cane mill of claim 1, further comprising a screen mounted on the trash plate and extending between the fourth roller and the inlet roller for preventing juices extracted in the opening between the fourth roller and the upper roller from dripping onto the inlet roller and for guiding said juices towards an inlet end of the mill.

6. The sugar cane mill of claim 5, further comprising a pivoting gate mounted on the support for movement between two selected positions with respect to the screen, a main juice collector arranged to collect juices received from the inlet and outlet openings, a separate juice collector arranged to collect juices from the opening between the fourth and upper rollers, and the gate guiding the juices into a respective one of the collectors in a respective one of the selected positions.

7. A system for the extraction of sugar from sugar cane, which comprises a battery of sequentially arranged sugar cane mills each including an inlet roller, an outlet roller and an upper roller resiliently biased towards the inlet and outlet rollers, the upper roller defining inlet and outlet openings with the inlet and outlet rollers, respectively, wherein the sugar cane is crushed into bagasse in the openings and juices are extracted from the bagasse in the openings; permeable conveyors arranged between successive ones of the mills for feeding the bagasse from mill to mill in a feeding direction; means for directing the juices extracted in each one of the mills to the bagasse fed on the conveyors to a preceding one of the mills, except for a first one of the mills, for imbibing the bagasse with the extracted juices from the succeeding mill; one of the mills being a mill comprising a frame, an inlet roller and an outlet roller mounted on the frame, an upper roller resiliently biased towards the inlet and outlet rollers, the upper roller defining inlet and outlet openings with the inlet and outlet rollers, respectively, a support and a pivot extending parallel to the inlet and outlet rollers and pivotally mounting the support on the frame, a fourth roller mounted on the support forwardly of, and at about the same level as, the upper roller and above the inlet roller, the fourth roller having about the same diameter as, and defining an opening with, the upper roller, means acting upon the support for resiliently biasing the fourth roller mounted thereon towards the upper roller, adjustable stop means arranged to prevent the fourth roller resiliently biased towards the upper roller from contacting the upper roller, a trash plate placed between the fourth roller and the inlet roller, the trash plate being mounted on the support, a screen mounted on the trash plate and extending between the fourth roller and the inlet roller for preventing juices extracted in the opening between the fourth roller and the upper roller from dripping onto the inlet roller and for guiding said juices towards an inlet end of the one mill, a pivoting gate mounted on the support for movement between two selected positions with respect to the screen, a main juice collector arranged to collect juices received from the inlet and outlet openings, a separate juice collector arranged to collect juices from the opening between the fourth and upper rollers, and the gate guiding the juices into a respective one of the collectors in a respective one of the selected positions; and further comprising means for recycling the juices extracted in the nip between the fourth roller and the upper roller of the one mill for imbibing the bagasse fed to the one mill.

8. The sugar extraction system of claim 7, wherein the means for recycling the juices is arranged to imbibe the bagasse fed to the last-mentioned mill upstream of the point where the bagasse fed to the last-mentioned mill is imbibed with the juices extracted from the succeeding mill.

9. A system for the extraction of sugar from sugar cane, which comprises a battery of sequentially arranged sugar cane mills including rollers defining openings wherein the sugar cane is crushed into bagasse and juices are extracted from the bagasse in the openings; one of the mills being a mill comprising a frame, an inlet roller and an outlet roller mounted on the frame, an upper roller resiliently biased towards the inlet and outlet rollers, the upper roller defining inlet and outlet openings with the inlet and outlet rollers, respectively, a support and a pivot extending parallel to the inlet and outlet rollers and pivotally mounting the support on the frame, a fourth roller mounted on the support forwardly of, and at about the same level as, the upper roller and above the inlet roller, the fourth roller having about the same diameter as, and defining an opening with, the upper roller, means acting upon the support for resiliently biasing the fourth roller mounted thereon towards the upper roller, adjustable stop means arranged to prevent the fourth roller resiliently biased towards the upper roller from contacting the upper roller, a trash plate placed between the fourth roller and the inlet roller, the trash plate being mounted on the support, a screen mounted on the trash plate and extending between the fourth roller and the inlet roller for preventing juices extracted in the opening between the fourth roller and the upper roller from dripping onto the inlet roller and for guiding said juices towards an inlet end of the one mill, a pivoting gate mounted on the support for movement between two selected positions with respect to the screen, a main juice collector arranged to collect juices received from the inlet and outlet openings, a separate juice collector arranged to collect juices from the opening between the fourth and upper rollers, and the gate guiding the juices into a respective one of the collectors in a respective one of the selected positions; permeable conveyors arranged between successive ones of the mills for feeding the bagasse from mill to mill in a feeding direction; and means for recycling the juices extracted in each one of the mills, except for a first one of the mills, for imbibing the bagasse fed on a respective one of the conveyors to the respective one of the mills and for directing the juices extracted in each one of the mills succeeding the first mill to the bagasse fed on the conveyors to a preceding one of the mills for imbiding the bagasse additionally with the extracted juices from the succeeding mill.

10. The system of claim 9, wherein the means for recycling the juices to the one mill and for directing the juices from the succeeding mill to the last-mentioned mill are arranged to imbibe the bagasse fed to the last-mentioned mill first with the juices extracted in the opening defined by the fourth and upper rollers of the last-mentioned mill, then with the juices extracted in the inlet and outlet openings of the last-mentioned mill, and finally with the juices from the succeeding mill, in the feeding direction.

* * * * *